United States Patent [19]

Simeth

[11] Patent Number: 4,882,991

[45] Date of Patent: Nov. 28, 1989

[54] CHANGE-OVER INKING UNIT OF A SHEET-FED ROTARY PRESS

[75] Inventor: Claus Simeth, Offenbach am Main, Fed. Rep. of Germany

[73] Assignee: M.A.N. Roland Druckmaschinen Aktiengesellschaft, Offenbach am Main, Fed. Rep. of Germany

[21] Appl. No.: 296,356

[22] Filed: Jan. 10, 1989

Related U.S. Application Data

[63] Continuation of Ser. No. 90,117, Aug. 27, 1987, abandoned.

[30] Foreign Application Priority Data

Aug. 27, 1986 [DE] Fed. Rep. of Germany ..... 3629081

[51] Int. Cl.[4] ..... B41F 31/10; B41F 31/30

[52] U.S. Cl. ..... 101/350; 101/352

[58] Field of Search ..... 101/349, 351, 352, 350, 101/148, 363, 207, 208–210

[56] References Cited

U.S. PATENT DOCUMENTS

| | | | |
|---|---|---|---|
| 472,666 | 4/1892 | Cottrell | 101/351 |
| 1,715,741 | 6/1929 | Claybourn | 101/351 |
| 4,397,235 | 8/1983 | Fischer | 101/352 X |
| 4,520,729 | 6/1985 | Fischer | 101/352 |

*Primary Examiner*—J. Reed Fisher

*Attorney, Agent, or Firm*—Leydig, Voit & Mayer

[57] ABSTRACT

A sheet feed rotary press having a main ink feed unit and a plate cylinder, at least one of a plurality of transfer and applicator rolls coupled between the main ink feed unit and the plate cylinder being moveable to an inoperative position for selectively isolating a relatively short length group of applicator and transfer rolls from the main ink feed unit, and an additional quick acting ink feed unit that is selectively moveable into engagement with the short length roll group for supplying lesser quantities of ink to the plate cylinder through a shortened path via the short length roll group.

5 Claims, 1 Drawing Sheet

CHANGE-OVER INKING UNIT OF A SHEET-FED ROTARY PRESS

Figure 1:
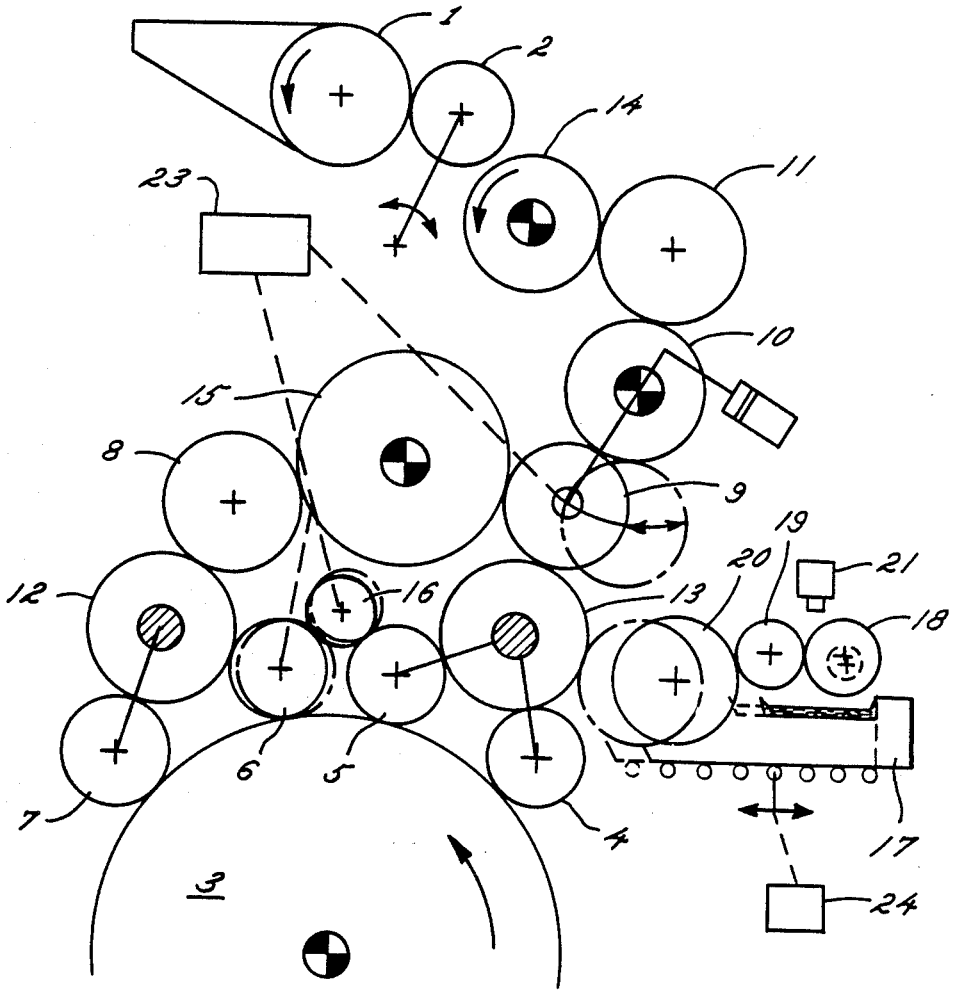

This application is a continuation of application Ser. No. 090,117, filed Aug. 27, 1987, now abandoned.

The present invention relates to change over inking units for sheet feed rotary presses.

Devices of this kind are known, as described in the introductory portion of German patent AS 1 234 739. A disadvantage of these known devices is that upon the interruption or completion of a printing operation they are not adapted to quickly supply small amounts of ink to a relatively few sheets, as commonly required for proof situations, for example, to assess register or control adjustments or the like. Known change over ink units react relatively slowly, requiring the ink passage through a long line of transfer rolls to build up the requisite ink-water equilibrium and to establish the desired layer density for transfer to the plate cylinder.

It is an object of the present invention to provide a change over inking system adapted to obviate disturbances of the ink-water equilibrium or ink layer density in the ink transfer rolls, as commonly occurs in the known change over inking units during run-on following completion or interruption of a printing operation.

Another object to provide a change over inking system as characterized above that includes a more quickly responsive short length inking unit that can be used for proof situations and minimum ink consumption printing when the main inking unit of the press is not operating or is unneeded.

Other objects and advantages of the invention will become apparent upon reading the following detailed description and upon reference to the drawings, in which:

FIG. 1 is a diagrammatic illustration of an illustrative sheet fed rotary printing press having a change over inking unit embodying the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative sheet fed rotary printing press embodying the invention. The printing press includes a plurality of applicator rolls 4–7 and plurality of transfer rolls 8–16 which are interposed between a first or main ink feeder, for example, a duct roll 1 and a vibrator roll 2, and the printing forme, for example, on a plate cylinder 3. During normal printing operations, when normal to maximum ink consumption is required, ink is transferred from the duct roll 1 and vibrator roll 2, through the transfer rolls 14, 11 and 10 to the transfer roll 9. From the transfer roll 9, ink is transferred through the transfer roll 13 to the applicator rolls 4 and 5 and also through the transfer rolls 15, 8 and 12 to the applicator rolls 5 and 6. The transfer roll 16 in this case is a connecting roll between applicator rolls 5 and 6. As is known in the art, such ink transfer smooths the ink to the desired density for transfer to the applicator rolls and printing form.

Selected groups of the transfer and applicator rolls preferably remain permanently engaged at all times. In this instance, transfer rolls 14, 11 and 10 are permanently engaged, transfer rolls 15, 18 and 12 are permanently engaged with applicator roll 7, and transfer rolls 13, 16 and applicator rolls 4, 5, and 6 remain engaged at all times.

Selectively operable means are provided for interrupting the flow of ink to the applicator rolls 4–7 from the main inking unit 1, 2 upon cessation or completion of the printing operation. In this instance, means, diagrammatically indicated at 23, are provided for moving the transfer roll 9 to an inoperative position disengaged from transfer rolls 15 and 13, as shown in phantom, and for moving the transfer roll 16 and applicator roll 6 out of engagement with transfer roll 12, while they respectively maintain contact with the cylinder roll 3 and applicator roll 5, again as shown in phantom. It will be appreciated that such moving means may be of a known type, such as eccentric mountings for the movable rolls, pneumatic cylinders, pivoted levers or the like, which are effective to separate transfer rolls 9 and 13 and rolls 12 and 6 to in effect isolate a relatively short length roll group 4–6, 13 and 16 from the main ink feeder. It will be understood that the rolls 4–6, 13 and 16 which form the short length inking roll group could be mounted in an inking unit frame, which, for example, could be pivoted about a central axis for the plate cylinder 3 or otherwise be moved as a unit during a change over operation.

In accordance with the invention, additional ink feeding means is provided which is selectively movable into operative relation with the short length roll group for more quickly providing relatively small amounts of ink to the plate cylinder, such as during run-on following cessation of a printing operation. To this end, an additional feeder 17 is provided which preferably is in the form of a quick acting ink unit comprising a dispensing roll 18, transfer rolls 19, 20 and a self-regulating ink feed facility 21. The separate quick acting inking unit is adapted to provide the desired ink-water equilibrium for minimum ink consumption much more rapidly than the main ink feeder so that it is particularly adaptable for proof work or other reduced ink consumption printing.

In keeping with the invention, the quick acting unit 17 is mounted for translational movement between a retracted or inoperative position, shown in solid lines in the drawing, to an in operative position engaging the transfer roll 13, as shown in phantom. Appropriate means, such as diagrammatically indicated at 24, may be provided for effecting such movement. Alternatively, the quick acting inking unit could be mounted for pivotable movement between operative and disengaged positions.

During normal operation of the sheet fed rotary printing press, with the quick acting inking unit in a retracted position, and with the rolls 9 and 6 in respective operative engagement with the transfer rolls 15 and 12, ink is supplied to the plate cylinder from the main inking unit for printing with normal to maximum ink consumption. Upon cessation of a normal printing operation, the transfer roll 9 may be moved to its disengaged position from transfer rolls 15 and 13, as shown in phantom in FIG. 1, and the applicator roll 6 is moved to a disengaged position from transfer roll 12, so as to interrupt the flow of ink from the main inking unit 1, 2 to the plate cylinder 3. At the same time, the quick acting inking unit 17 is moved into operative engagement with the transfer roll 13, so as to rapidly supply minimum quantities of ink to the plate cylinder for proof work, or reduced ink consumption printing. To resume normal printing, the rolls 9 and 6 again are moved into operative engagement with the main ink transfer line and the quick acting inking unit moved to its retracted position. However, when the printing operation requires substantially no ink, the change over to the main inking unit operation need not be required and only the short inking unit may be used. To prevent disturbances of the equilibrium state or of the ink layer thickness gradient of the transfer rolls 8–15 in response to an interruption of run-off in the main inking unit operation, the change over to the short inking unit operation can be coupled by known control means to the cessation of printing.

I claim:

1. A sheet-fed rotary press comprising main ink feed means, a plate cylinder, a plurality of transfer and applicator rolls coupled between said main ink feed means and said plate cylinder for defining an ink flow path for transferring ink in a downstream direction from said main ink feed means to said plate cylinder during printing operations, means mounting at least one of said transfer rolls which define said flow path for movement between an operative position in said flow path and an inoperative position out of engagement with said transfer and applicator rolls downstream thereof, means for selectively moving said at least one transfer roll from said operative position to said inoperative position for interrupting the transfer of ink from said main ink feed means to said plate cylinder and for isolating a short length roll group comprising only a portion of said plurality of transfer and applicator rolls, and additional ink feed means, and means for selectively moving said additional ink feed means from an inoperative position out of engagement with said short length roll group to an operative position engaging said short length roll group for supplying ink to said plate cylinder through a shortened flow path via said short length roll group.

2. The rotary printing press of claim 1 in which the transfer and applicator rolls of said short length group remain engaged with each other at all times.

3. The rotary printing press of claim 1 in which said transfer and applicator rolls include a plurality of applicator rolls, means mounting at least one of said applicator rolls for movement between an operative position in said ink flow path to an inoperative position out of engagement with other transfer and applicator rolls of said flow path, and means for simultaneously moving said at least one transfer roll and said at least one applicator roll from said operative to said inoperative positions for interrupting the supply of ink from said main ink feed means to said short length roll group.

4. The rotary printing press of claim 1 in which said additional ink feed means is operable for supplying lesser quantities of ink than said main ink feed means.

5. The rotary printing press of claim 4 in which said additional ink feed means is mounted for translational movement relative to said short length roll group.

* * * * *